United States Patent [19]

Johnson

[11] Patent Number: 4,727,586

[45] Date of Patent: Feb. 23, 1988

[54] HIGH FIDELITY SPEAKER SYSTEM AND ASSEMBLY

[76] Inventor: Charles A. Johnson, 629 Race St. Rear, Perkasie, Pa. 18944

[21] Appl. No.: 885,199

[22] Filed: Jul. 14, 1986

[51] Int. Cl.[4] ..... H04R 1/24

[52] U.S. Cl. ..... 381/186; 381/97; 381/182; 381/195; 381/184

[58] Field of Search ..... 381/97, 117, 186, 195, 381/182, 184, 160

[56] References Cited

U.S. PATENT DOCUMENTS

| | | | |
|---|---|---|---|
| 2,922,849 | 1/1960 | Uchida | 381/186 |
| 3,927,261 | 12/1975 | Dahlquist | 381/186 |
| 4,256,930 | 3/1981 | Garner | 381/195 |
| 4,289,929 | 9/1981 | Hathaway | 381/97 |
| 4,528,691 | 7/1985 | Edwards | 381/97 |
| 4,590,333 | 5/1986 | Strohbeen | 381/195 |

FOREIGN PATENT DOCUMENTS

| | | | |
|---|---|---|---|
| 5233517 | 3/1977 | Japan | 381/97 |

*Primary Examiner*—Jin F. Ng
*Assistant Examiner*—L. C. Schroeder
*Attorney, Agent, or Firm*—Joseph W. Molasky & Assoc.

[57] ABSTRACT

A speaker system and assembly achieves a high fidelity sound reproduction by causing acoustical waves emanating from juxtaposed and co-axially positioned first and second speakers, which produce respective mid-range and treble frequencies, to reach a listener simultaneously.

7 Claims, 2 Drawing Figures

FIG. 1
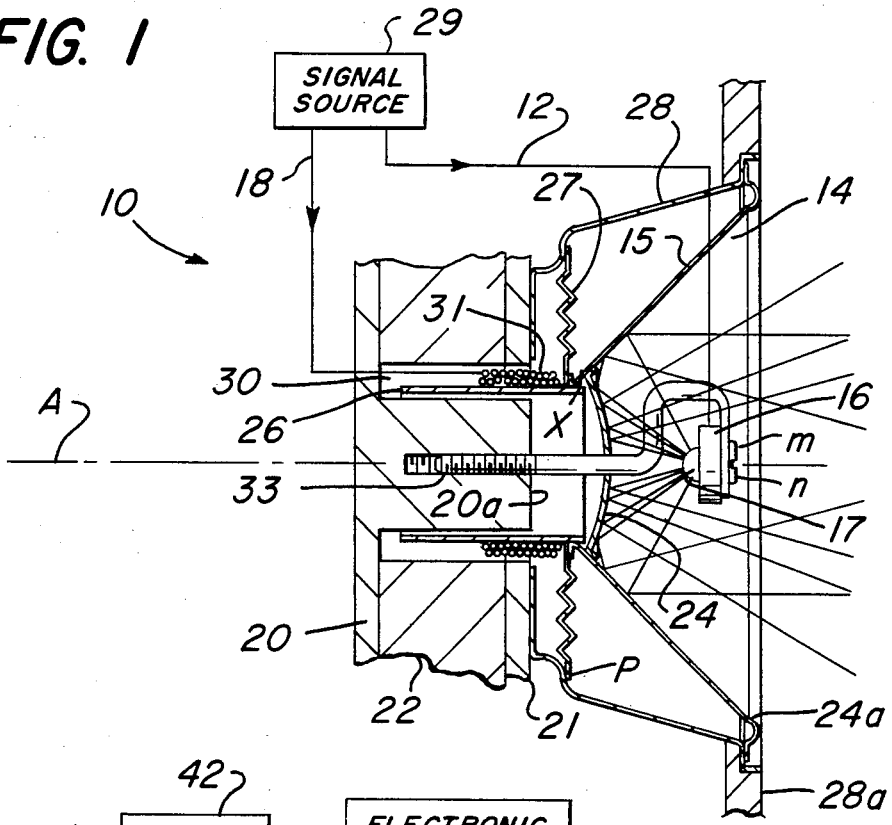
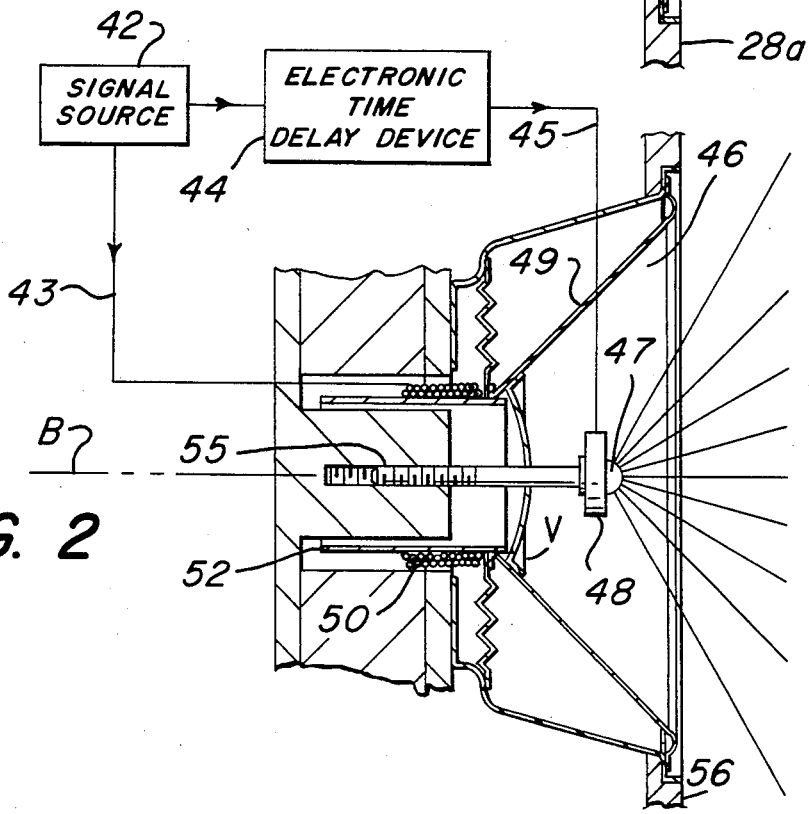
FIG. 2

HIGH FIDELITY SPEAKER SYSTEM AND ASSEMBLY

BACKGROUND OF THE INVENTION

1. Field of the Invention

The present invention relates in general to sound reproduction, and in particular, relates to a loudspeaker system and assembly which transmits a high fidelity sound spectrum from separated but proximately positioned co-axial speakers.

2. Description of the Prior Art

It is generally recognized that known prior art coaxial speaker systems are designed for purposes of mechanical advantage rather than to achieve excellence of sound reproduction. Thusly, co-axial speaker systems have been developed primarily to occupy a relatively small space as, for example, on a rear deck of an automobile. Such prior art co-axial speaker systems are characterized by an inability to properly allow the sound reproduction of one speaker to be phased with the sound reproduction of the second speaker. In the present invention a co-axial speaker assembly and system has been developed to produce an improved high fidelity sound spectrum wherein both speakers of the co-axial assembly are correctly phased with one another.

In U.S. Pat. No. 3,824,343 to Dahlquist there is disclosed a large loudspeaker system which utilizes staggered speakers to achieve a correctly phased sound reproduction. The various speakers in the cited patent are mounted in a staggered fashion by arranging them in different spatial planes so that they all will be in the correct time plane or in a phased array with respect to a listener. This staggered system is correctly phased when the listener is directly on axis with the system as a whole. In other words, unless the listener is properly positioned in front of the system he cannot receive a high fidelity sound reproduction. The instant invention achieves a phased array system wherein the speakers are co-axially aligned and further achieves a coherent sound, i.e., one that is largely free of time delay distortion between speakers of the system even for off-axis listening positions.

SUMMARY OF THE INVENTION

The present invention provides a speaker system and assembly which incorporates a pair of co-axial and closely positioned speakers. The first speaker of the assembly is a larger structure and is designed to reproduce or transduce mid-range audio frequencies from a signal source; the smaller second speaker transduces high frequencies from the same signal source. The assembly attains a high fidelity sound reproduction by generating acoustical waves which emanate from the respective first and second speakers in a manner to reach a listener simultaneously.

In one embodiment of the invention the second speaker is positioned within the first speaker in a facing relationship with one another such that an acoustical wave produced by the second speaker when activated by the signal source is projected backwardly against a radiating surface of the first speaker prior to being reflected outwardly toward the listener. The reflected wave emanating from the second speaker is designed to arrive at the listener at the same time as the acoustical wave arrives from the activated first speaker. As a consequence of this acoustical transmission, the respective waves reach the listener simultaneously to produce a high fidelity sound spectrum.

In another embodiment of the invention the speakers of the assembly are both oriented in a facing direction with respect to the listener, however, the second speaker is positioned slightly forward within the radiating surface of the first speaker. In this embodiment, the acoustical wave emanating from the second speaker is slightly retarded by delaying the application of the signal source thereto with respect to that of the first speaker. In effect, therefore, the acoustical waves generated from the second speaker wait for the waves of the first to catch-up before they are simultaneously transmitted to the listener.

It is therefore an object of this invention to provide a new and improved high fidelity speaker assembly and system.

It is still another object of this invention to provide a new and improved co-axial speaker assembly and system that produces a high fidelity sound spectrum.

BRIEF DESCRIPTION OF THE DRAWINGS

FIG. 1 depicts a cross-sectional view of an embodiment of the invention depicting a co-axial speaker system wherein the high frequency speaker is oriented in a facing relationship with the mid-range frequency speaker.

FIG. 2 further depicts in cross-section another co-axial speaker embodiment of the invention wherein the signal source is applied through a time delay to the high frequency speaker and directly to the mid-range frequency speaker.

DESCRIPTION OF THE PREFERRED EMBODIMENTS

Referring now to a preferred embodiment of FIG. 1 in cross-sectional detail there is depicted the speaker assembly and system 10 of the present invention. The speaker assembly 10 is essentially comprised of a large speaker 14 and a small speaker 16. The speaker 14 is circular in shape and co-axially oriented with respect to the smaller speaker 16 by being located on an imaginary line A through their respective centers. The small speaker or tweeter 16 is designed to produce acoustical waves in the air that are translated into a treble frequency on an order of 6,000–20,000 Hertz when energized by a signal source 29. In the embodiments of this invention the large speaker 14 within which speaker 16 is encompassed produces acoustical waves in an overlapping mid-range frequency band on an order of 150 to 10,000 Hertz when simultaneously energized by the signal source 29. The mid-range frequency band may be roughly defined as having a range between the treble and certain bass frequencies.

Speaker 14 employs a cone 15 which is a diaphragm-like member made of paper, although material such as polypropylene or other plastics may be substituted for the paper without diminution of performance. The cone 15 together with a dust cover 24 provides a sound radiating surface for speaker 14. A former 26, which is attached to cone 15 at junction X is utilized for locating and positioning a voice coil 31 thereon. The voice coil 31 is made of copper wire and is designed to carry an electrical current from signal source 29. As understood in the art, the acoustical waves associated with the mid-range frequencies are produced by a to-and-fro motion of cone 15 when the electrical current from signal source 29 is applied to the voice coil 31 of speaker 14 via conducting wire 18. The signal source 29 is grounded (now shown) as is one end of voice coil 31 in order to provide a complete electrical circuit, as is understood by those skilled in the art. The electrical current corresponds to a spectrum of complex frequencies that, for example, represents music. These complex frequencies may be composed of fundamental and harmonic tones which are to be reproduced by the speaker 14.

A permanent, doughnut shaped ceramic magnet 22, which is made of a ferrite material, is located rearwardly of the speaker cone 15. The magnet 22 is encased within respective rear and front pole pieces 20 and 21, which are made of highly permeable iron. An extension 20*a* is integrally joined to the rear pole piece 20. A circular air gap 30 is provided within the magnet 22, pole pieces 20, 21 and around the iron extension 20*a*. Permanent magnet 22, the rear and front pole pieces 20, 21 and extension 20*a* comprise a magnetic circuit which operates to provide an intense magnetic field which is generated across the air gap 30. The voice coil 31 is situated in the magnetic field and particularly across the air gap area lying between the highly permeable front pole piece 21 and the rear pole piece extension 20*a*. The magnetic field generated across the air gap interacts with the magnetic field produced by the voice coil 31 when the latter is appropriately energized by the signal source 29. This interaction creates the to-and-fro motion of the voice coil 31 which, in turn, causes a pulsating movement of the former 26 and the cone 15. It is the pulsating movement of the speaker cone 15 which creates acoustical waves in the air corresponding to the respective mid-range frequencies from the signal source 29 which are to be reproduced.

The cylindrically-shaped former 26 is enclosed at one end by a dust cover 24 which is made of a paper material circumferentially attached to an inside area of the cone 15 at location R. A metal basket 28 surrounds the conically shaped speaker 14 to provide an air tight seal and mechanical support thereto. This air tight seal is designed to prevent acoustical output generated by the rear of the cone 15 from reaching the front of the speaker where phase cancellation would occur. Located at the rear of speaker 14 is a flexible, corrugated-shaped suspension member 27 which is circumferentially attached to the basket 28 at location P. The member 27 is sometimes referred to as a spider and it is designed together with another flexible suspension member 24*a* joining an extremity of cone 15 to the metal basket 28 to facilitate the to-and-fro motion of the speaker cone 15 without twisting or side motion. Accordingly, the suspension members 24*a*, 27 are fabricated of rubber or resin threated material that is not rigid.

The tweeter 16 which is co-axially positioned along center-line A is located within the sound radiating surface of the mid-range speaker 14 by means of a threaded post 33. This may be accomplished by threading one end of the post 33 for attachment to the pole piece extension 20*a*; another end thereof is connected to the tweeter 16 by appropriate fasteners m, n. The tweeter 16 may also be located axially by means of a support (not shown) attached to a baffle 28*a*, which is partically depicted in FIG. 1, across a diameter of the cone 15. As is understood, the baffle 28*a* is a portion of an enclosure (not shown) upon which speakers 14, 16 are mounted. In the preferred embodiment, the tweeter 16 comprises a piezoelectric element which has a small diameter on an order of three-quarters of an inch. The use of a smaller diameter piezoelectric element will become apparent in later paragraphs. Tweeter 16 is oriented in a facing relationship with respect to the speaker 14 so that its sound radiating element 17 is directed inwardly against the sound radiating surface consisting of cone 15 and dust cover 24 of speaker 14. In other words, it is positioned backwardly with respect to a listener who is positioned in front of speaker 14 and within its sound radiating surface. Therefore, the energizing by the signal source 29 by way of conductor 12 of tweeter 16 produces acoustical waves that travel toward and impinge upon the sound radiating surface of speaker 14. As understood, the tweeter 16 is grounded (not shown) to complete the electrical signal path with signal source 29. The acoustical waves are represented by the rays emanating from the radiating element 17. The energizing of the mid-range speaker 14 via conductor 18 produces a plurality of waves originating in the voice coil 31 which are transmitted through former 26. These waves arrive at the dust cover 24 and cone 15 simultaneously with the arrival of the waves from the tweeter 16. The waves generated from the mid-range speaker 14 transfer from the cone 15 and dust cover 24 and emerge into the air medium as acoustical waves at the instant that the acoustical waves from the tweeter 16 are reflected and transmitted toward the listener from the dust cover 24 and cone 15. As is understood, the tweeter 16 reproduces a spectrum of complex frequencies in a manner of speaker 14.

In order to create a high fidelity sound reproduction in accordance with the present invention as described with respect to FIG. 1, the audio signal is conducted from the source 29 through the mid-range speaker 14 to the listener with a time of travel that is equal to a time of travel of the same signal from source 29 through the tweeter 16 to the listener. Achieving this precise timing necessitates precise positioning of tweeter 16 with respect to speaker 14. A benefit derived from the precisely timed co-axial positioning (i.e., coincident with imaginary line A of FIG. 1) is that the listener receives correctly phased sound reproduction. This results from a close proximity and co-axial relationship of speakers 14, 16. Speaker 16 as utilized in this invention is dimensionally small so as to minimize interference with either acoustical waves emerging from the sound radiating surface of mid-range speaker 14 or with acoustical waves reflected therefrom. As understood, these reflected waves emanate from tweeter 16.

Referring now to FIG. 2 there is shown another coaxial speaker embodiment of the invention which utilizes a midrange speaker 46 and a tweeter 48. Tweeter 48 is mounted within speaker 46 by mounting upon a threaded post 55. The tweeter 48 may also be mounted on an air (not shown) extending across speaker 46 and mounted on baffle 56. However, the speakers 46, 48 directly face the listener (not shown) and in all other respects they are structually identical to those described with respect to FIG. 1. Speaker 46 includes a radiating surface consisting of cone 49 and dust cover 51. In this embodiment, the signal source 42 is applied via conductor 43 directly to the voice coil 50 of speaker 46, and through a time delay device 44 via conductor 45 to the tweeter 48. The sound radiating element 47 of tweeter 48 is positioned closer to the listener than is junction V which is located between the cone 49 and the dust cover 51. In other words, junction V is a location on the radiating surface of speaker 46. It is junction V from which sound first emerges in comparison with other areas of the radiating surface of speaker 46. Speaker 48 which is a piezoelectric type is dimensionally small and it activates its sound radiating element 47 nearly instantaneously. In contrast with the position of the sound radiating element 47, the junction V is further from the listener. Therefore, acoustical waves produced by speaker 48 would reach the listener prior to acoustical waves produced by mid-range speaker 46. In order to accommodate this spatial difference the acoustical waves generated from tweeter 48 are electronically delayed by time delay device 44. This allows the acoustical waves emanating from speaker 46 to catch up with those emanating from speaker 48 so that both will reach the listener simultaneously. Therefore, an audio signal is transmitted from the source 42 through the mid-range speaker 46 to the listener with a time of travel that is equal to a time of travel from signal source 42 through delay device 44 and the second speaker 48 to the listener.

This invention has been described by reference to precise embodiments but it will be appreciated by those skilled in the art that this concept is subject to variation and modification and to the extent that these are within the skill of the artisan to effect, said variations and modifications are included within the scope of the appended claims.

What is claimed is:

1. A method for transducing an audio signal from a source through a speaker assembly toward a listener by utilizing a first speaker which reproduces a mid-range band of frequencies, in combination with a second speaker which reproduces a high band of frequencies comprising the steps of:

(a) positioning the first and second speakers co-axially and in proximity with respect to one another;

(b) orienting said second speaker with respect to said first speaker in a facing relationship and for causing said audio signal to be transmitted from said source through the first speaker to the listener with a time of travel that is substantially equal to a time of travel of said signal from said source through said second speaker to the listener; and (c) whereby said transduced audio signal reaches said listener with high fidelity.

2. The method for transducing an audio signal in accordance with claim 1 wherein said first speaker includes a sound radiating surface and comprising the further step of:

(a) positioning said second speaker within the volume bounded by said sound radiating surface of said first speaker.

3. The method for transducing an audio signal in accordance with claim 2 and further comprising the step of:

(a) reflecting the audio signal from said source and transduced by said second speaker off of the sound radiating surface of said first speaker for transmission to said listener;

(b) such that the transduced signal of said second speaker reaches the listener nearly simultaneously with the transduced signal emanating from said first speaker, which is transmitted directly from said radiating surface to said listener.

4. An audio speaker assembly for creating a sound reproduction in a middle and a high frequency band from a signal source comprising:

(a) a first speaker device having a sound radiating surface for transmission of said middle frequency band, said radiating surface being oriented to face a listener;

(b) a smaller second speaker device co-axially positioned with respect to and in proximity with said first speaker device for generating said high frequency band, said second speaker device further being oriented in a direction away from said listener and facing said sound radiating surface;

(c) whereby when said first and second speakers are activated by said signal source said midrange frequency band emanates directly from said radiating surface for transmission to said listener whereas said high frequency band is reflected off of the radiating surface for transmission to said listener, (d) said first and second speakers being positioned relative to one another so that direct and reflected frequencies reach the listener at substantially the same time in order to produce a high fidelity sound reproduction.

5. An audio speaker assembly in accordance with claim 4 wherein said smaller second speaker device comprises a piezoelectric type speaker.

6. A method for transducing an audio signal from a source through a speaker assembly toward a listener by utilizing a first speaker which reproduces a mid-range band of frequencies, in combination with a second speaker which reproduces a high band of frequencies comprising the steps of:

(a) positioning the first and second speakers co-axially and in proximity with respect to one another;

(b) causing sound reproduction transduced from said audio signal and source to be initially generated and propagated directly from said first speaker to said listener; and further (c) causing sound reproduction transduced from said audio signal and source to be initially generated and propagated from said second speaker directly toward the first speaker and after reflection therefrom toward the listener;

(d) positioning said first and second speakers with respect to one another so that the directly transmitted and reflected sound reproduction will reach the listener at substantilly the same time; and (e) whereby said transduced audio signal reaches said listener with high fidelity.

7. A speaker assembly for creating a sound reproduction in a middle and a high frequency band from a signal source comprising:

(a) a first speaker device having a sound radiating surface for transmission of said middle frequency band, said radiating surface being oriented to face a listener;

(b) a smaller second speaker device co-axially positioned with respect to and in proximity with said first speaker device for generating said high frequency band, said second speaker device further being oriented in a direction away from said listener and facing said sound radiating surface;

(c) such that sound reproduction originating from said audio signal and source is initially generated and propagated directly from said first speaker to said listener;

(d) sound reproduction originating from said audio signal and source being initially generated and propagated from said second speaker directly toward the first speaker and after reflection therefrom toward the listener; and (e) said first and second speakers being positioned relative to one another so that said respective direct and reflected sound reproduction reaches the listener at substantially the same time in order to provide high fidelity audio signal for a listener.

* * * * *